US011133594B2

(12) United States Patent
Ahmadloo

(10) Patent No.: US 11,133,594 B2
(45) Date of Patent: Sep. 28, 2021

(54) SYSTEM AND METHOD WITH MULTILAYER LAMINATED WAVEGUIDE ANTENNA

(71) Applicant: Veoneer US, Inc., Southfield, MI (US)

(72) Inventor: Majid Ahmadloo, Lowell, MA (US)

(73) Assignee: VEONEER US, INC., Southfield, MI (US)

( * ) Notice: Subject to any disclaimer, the term of this patent is extended or adjusted under 35 U.S.C. 154(b) by 211 days.

(21) Appl. No.: 16/240,057

(22) Filed: Jan. 4, 2019

(65) Prior Publication Data

US 2020/0220273 A1 Jul. 9, 2020

(51) Int. Cl.

| | |
|---|---|
| ***H01Q 13/06*** | (2006.01) |
| ***H01Q 1/42*** | (2006.01) |
| ***H01Q 13/18*** | (2006.01) |
| ***H01Q 23/00*** | (2006.01) |

(52) U.S. Cl.

CPC ..... *H01Q 13/06* (2013.01); *H01Q 1/422* (2013.01); *H01Q 13/18* (2013.01); *H01Q 23/00* (2013.01)

(58) Field of Classification Search

CPC .... H01Q 21/0043; H01Q 13/06; H01Q 1/422; H01Q 23/00; H01Q 13/18; H01Q 9/0457; H01P 3/121; H01P 5/107

See application file for complete search history.

(56) References Cited

U.S. PATENT DOCUMENTS 4,301,457 A * 11/1981 Bogner ..... H01Q 19/06 343/770
4,431,996 A * 2/1984 Milligan ..... H01Q 1/286 343/708
5,043,738 A * 8/1991 Shapiro ..... H01Q 5/385 343/700 MS (Continued)

FOREIGN PATENT DOCUMENTS

EP 1764863 A1 3/2007
WO 2017/167987 A1 10/2017

(Continued)

OTHER PUBLICATIONS

International Search Report and Written Opinion for International Application No. PCT/US2019/065660 dated Mar. 6, 2020.

*Primary Examiner* — Graham P Smith
*Assistant Examiner* — Jae K Kim
(74) *Attorney, Agent, or Firm* — Burns & Levinson LLP; Steven M. Mills

(57) ABSTRACT

A waveguide antenna apparatus includes a lower laminate layer of non-radio-frequency (RF) material and a first layer of conductive material formed on a top surface of the lower laminate layer of non-RF material. A middle layer of non-RF material formed over the first layer of conductive material, the middle layer of non-RF material comprising a waveguide cavity formed through the middle layer of non-RF material, such that air forms a propagation medium for radiation in the waveguide cavity. An upper layer of non-RF (Continued)

material is formed over the middle layer of non-RF material, and a second layer of conductive material is formed on a top surface of the upper layer of non-RF material, the first and second layers of conductive material and the waveguide cavity being part of a waveguide antenna.

19 Claims, 4 Drawing Sheets

(56) References Cited

U.S. PATENT DOCUMENTS 5,907,305 A * 5/1999 Epp ..... H01Q 1/38 343/700 MS
6,476,696 B1 * 11/2002 Mack ..... H01P 3/12 333/157
6,492,949 B1 * 12/2002 Breglia ..... G01S 13/346 343/700 MS
6,496,147 B1 12/2002 Kirino
6,556,168 B1 * 4/2003 Marumoto ..... H01Q 21/0087 342/372
7,450,071 B1 * 11/2008 Volman ..... H01Q 1/02 343/700 MS
2003/0067410 A1 * 4/2003 Puzella ..... H01Q 9/0407 343/700 MS
2004/0150561 A1 * 8/2004 Tillery ..... H01Q 1/246 343/700 MS
2007/0026567 A1 * 2/2007 Beer ..... G01S 19/36 438/106
2008/0105966 A1 5/2008 Beer
2010/0148892 A1 * 6/2010 Tsutsumi ..... H01P 1/04 333/254
2010/0182105 A1 * 7/2010 Hein ..... H05K 1/0219 333/239
2012/0256796 A1 * 10/2012 Leiba ..... H01Q 1/2283 343/702
2015/0117862 A1 * 4/2015 Trotta ..... H05K 1/0242 398/115
2016/0126636 A1 * 5/2016 Uemichi ..... H01Q 13/18 343/771
2016/0126637 A1 * 5/2016 Uemichi ..... H01Q 13/22 343/771
2016/0226148 A1 * 8/2016 Ashida ..... H01P 5/087
2017/0187124 A1 * 6/2017 Kirino ..... H01Q 1/3266
2017/0194716 A1 * 7/2017 Kirino ..... H01Q 13/10
2018/0026378 A1 * 1/2018 Hadavy ..... H01Q 21/064 343/771
2018/0351261 A1 * 12/2018 Kamo ..... H01Q 21/064
2020/0076037 A1 * 3/2020 Kishk ..... H01P 3/08
2020/0076086 A1 * 3/2020 Cheng ..... H01Q 21/205
2020/0106152 A1 * 4/2020 Fruehling ..... H01P 5/107
2020/0127386 A1 * 4/2020 Yekan ..... H01Q 1/3233
2020/0153108 A1 * 5/2020 Uemichi ..... H01Q 21/005
2020/0168974 A1 * 5/2020 Vosoogh ..... H01P 1/2005
2020/0343648 A1 * 10/2020 Tehran ..... H01Q 21/064

FOREIGN PATENT DOCUMENTS

WO 2017182077 A1 10/2017
WO 2018/236286 A1 12/2018

* cited by examiner

SYSTEM AND METHOD WITH MULTILAYER LAMINATED WAVEGUIDE ANTENNA

BACKGROUND

1. Technical Field

The present disclosure is related to radar detection systems and, in particular, to an antenna system for an automotive radar system using low-cost non-radio-frequency (RF) laminate materials for the antenna structure and/or RF front end, and an automotive radar system utilizing the same.

2. Discussion of Related Art

In conventional automotive radar sensor modules, electronic components are mounted on a printed circuit board (PCB). For example, both transmit (Tx) and receive (Rx) antenna components can be implemented by forming arrays of antenna "patches" on the surface of the PCB. These patches, as well as associated components such as feed lines, strip lines, waveguides and RF transition elements, e.g., waveguide-to-microstrip line transitions, are commonly formed by depositing metal and/or other conductive material on the surface of the PCB in a predetermined desired pattern.

Typically, PCBs are made of any standard inexpensive PCB material, such as, for example, FR4, which is a well-known National Electrical Manufacturers Association (NEMA) grade designation for glass-reinforced epoxy laminate material. This exemplary material and other such low-cost, non-RF materials will be referred to collectively herein as FR4. Typical automotive radar systems operate at high RF, for example, 24 GHz or 76-81 GHz. At such frequencies, the electronic characteristics of the conventional FR4 PCB material, e.g., dielectric constant and loss, can significantly change and degrade performance of the sensor, such as by antenna pattern degradation or by changing the coupling pattern of high-frequency Tx antenna signals to the Rx antenna patches or other circuitry in the sensor module. In general, the use of the FR4 material can result in overall degradation in performance of the RF antenna components and/or RF front end components, including feed lines, strip lines, waveguides and RF transition elements, e.g., waveguide-to-microstrip line transitions.

To mitigate the effects of these phenomena, the PCB in some conventional sensors has been made of or includes a special high-performance, high-frequency RF material which reduces these effects. This more specialized RF material, can be, for example, Astra® MT77 very low-loss high-frequency material, Rogers Corporation RO3003 or RO4350 ceramic-filled polytetrafluoroethylene (PTFE) composite high-frequency circuit material, or low-temperature co-fired ceramic (LTCC) material, or other similar material. A significant drawback to this approach is that these high-performance, high-frequency RF materials can be very expensive. Also, fabrication of the PCB can be complex and expensive since all of the electronic components in the sensor, including the high-frequency RF components (antennas, feed lines, strip lines, waveguides, RF transition elements, etc.), need to be formed in place on the PCB. Also, all of the associated support circuitry including digital components such as processors, memories, amplifiers, busses, as well as individual passive electronic components, e.g., resistors, capacitors, etc., must also be installed on the surface of the PCB. Also, fabrication processes can negatively affect performance of the RF circuitry and antennas due to the high sensitivity of such components to the material change resulting from exposure to solutions and processes used during fabrication of the PCB.

Furthermore, in the fabrication of RF structures such as waveguide antennas, the material of which the interior of the waveguide is made can introduce substantial RF loss, particularly at the high RF frequencies of interest. While it would be desirable to fabricate such structures from the relatively inexpensive FR4 material, given the loss involved and the resulting degradation in system performance, such an approach has many substantial drawbacks.

SUMMARY

A waveguide antenna apparatus includes a lower laminate layer of non-radio-frequency (RF) material and a first layer of conductive material formed on a top surface of the lower laminate layer of non-RF material. A middle layer of non-RF material is formed over the first layer of conductive material, the middle layer of non-RF material comprising a waveguide cavity formed through the middle layer of non-RF material, such that air forms a propagation medium for radiation in the waveguide cavity. An upper layer of non-RF material is formed over the middle layer of non-RF material, and a second layer of conductive material is formed on a top surface of the upper layer of non-RF material, the first and second layers of conductive material and the waveguide cavity being part of a waveguide antenna.

In some exemplary embodiments, the second layer of conductive material comprises a pattern of openings. The pattern of openings can include a pattern of slots such that the waveguide antenna is a slot antenna. Alternatively, the pattern of openings can include a pattern of patch openings such that the waveguide antenna is a slotted waveguide antenna. Alternatively, the pattern of openings comprises a pattern of patch openings such that the waveguide antenna can be configured as a differential pair antenna. In some exemplary embodiments, the apparatus further includes a protecting layer of non-RF material formed over the second layer of conductive material to seal the openings, the protecting layer functioning as a radome.

In some exemplary embodiments, the apparatus further includes a plurality of through vias formed through the all layers of non-RF material and surrounding the waveguide cavity to define a boundary of the waveguide cavity.

In some exemplary embodiments, the non-RF material comprises low-cost non-RF glass-reinforced epoxy laminate material.

In some exemplary embodiments, the apparatus further includes a feeding structure for coupling the waveguide antenna to associated circuitry. The associated circuitry can be formed on at least one of the lower and upper layers of non-RF material. The associated circuitry can be formed on both of the lower and upper layers of non-RF material. The associated circuitry can include a monolithic microwave integrated circuit (MMIC).

In some exemplary embodiments, the associated circuitry includes a monolithic microwave integrated circuit (MMIC) mounted over the top surface of the upper layer of non-RF material and other associated circuitry mounted under a bottom surface of the lower layer of non-RF material; and the feeding structure comprises a first connection between the MMIC and the other associated circuitry and a second connection between the MIMIC and the waveguide antenna.

In some exemplary embodiments, the associated circuitry comprises a monolithic microwave integrated circuit (MMIC) and other associated circuitry mounted under a bottom surface of the lower layer of non-RF material; and the feeding structure comprises a connection between the MIMIC and the waveguide antenna.

In some exemplary embodiments, the associated circuitry comprises a monolithic microwave integrated circuit (MMIC) mounted under a bottom surface of the upper layer of non-RF material and within the waveguide cavity and other associated circuitry mounted under a bottom surface of the lower layer of non-RF material; and the feeding structure comprises a connection between the MMIC and the waveguide antenna.

The waveguide antenna can be a receive antenna structure or a transmit antenna structure.

In some exemplary embodiments, the apparatus further includes multiple waveguide cavities and radiating slots forming multiple transmit and receive antennas tightly placed in a single laminar package.

In some exemplary embodiments, a configuration of radiating slots is selected to radiate various polarizations such as vertical and/or horizontal polarizations.

BRIEF DESCRIPTION OF THE DRAWINGS

The present disclosure is further described in the detailed description which follows, in reference to the noted plurality of drawings by way of non-limiting examples of embodiments of the present disclosure, in which like reference numerals represent similar parts throughout the several views of the drawings.

FIG. 3A illustrates a configuration in which the MMIC of the system is located on the top laminate layer of the structure, FIG. 3B illustrates a configuration in which the MMIC of the system is located on the bottom side of the bottom laminate layer of the structure, and FIG. 3C illustrates a configuration in which the MMIC of the system is located on the bottom side of the top laminate layer, such that the MIMIC is located within the waveguide cavity of the structure.

DETAILED DESCRIPTION

According to the present disclosure, automotive radar sensor modules are provided with a low-cost solution for the antenna(s) and RF front end based on low-cost commonly used laminates, such as FR4, to perform at higher frequencies used in automotive radar solutions, e.g., 24 GHz and/or 76-81 GHz, without the need to utilize high-cost, high-frequency substrates. This solution can also include the digital circuitry in a single-board format and, hence, provide a compact complete solution. According to the exemplary embodiments, since the more expensive laminate materials, such as Astra® MT77, Rogers RO3003 or RO4350, or other similar materials are not used, and only standard printed circuit board fabrication techniques are required, the cost and complexities of fabrication are significantly reduced, while the RF performance is maintained or improved.

According to the present disclosure, waveguides such as rectangular waveguides are structured by stacking laminates or layers of FR4 material, or other similar material. The resulting high-frequency waveguides are air-filled such that they have very low loss and high performance in guiding and radiating the electromagnetic waves propagating through them. This is a virtually ideal configuration in antenna structure, since only air and high-conductivity materials, such as copper, are utilized. As a result, the lossy and dispersive behavior of RF substrates are fully avoided on the RF side of the system.

According to the disclosure, various feeding structures can be used to directly take the signal from circuitry, such as a monolithic microwave integrated circuit (MMIC), at the MIMIC pins and deliver it to the desired waveguide. The MMIC can be placed on either side of the PCB, i.e., the RF side or the opposite side.

In the exemplary embodiments, due to the use of waveguide structures, multiple radiating configurations are possible. For example, slots can be etched on the radiating face of the waveguide to provide wide range of desired antenna gains, polarizations and beam performances. When it is desirable to place antennas very close to each other, such as when two transmit arrays TX1 and TX2 are to be placed a half wavelength apart to generate sum (in phase) and delta (out of phase) patterns, multiple rows of radiating slots can be provided to achieve such patterns. In some exemplary embodiments, because full separation of each waveguide antenna from the adjacent antennas is achieved by applying isolating vias, the isolation between antennas is also greatly improved. Other forms of antennas, such as differential fed antennas using higher-order modes to radiate can also be realized using the techniques of the present disclosure.

Figure 1:
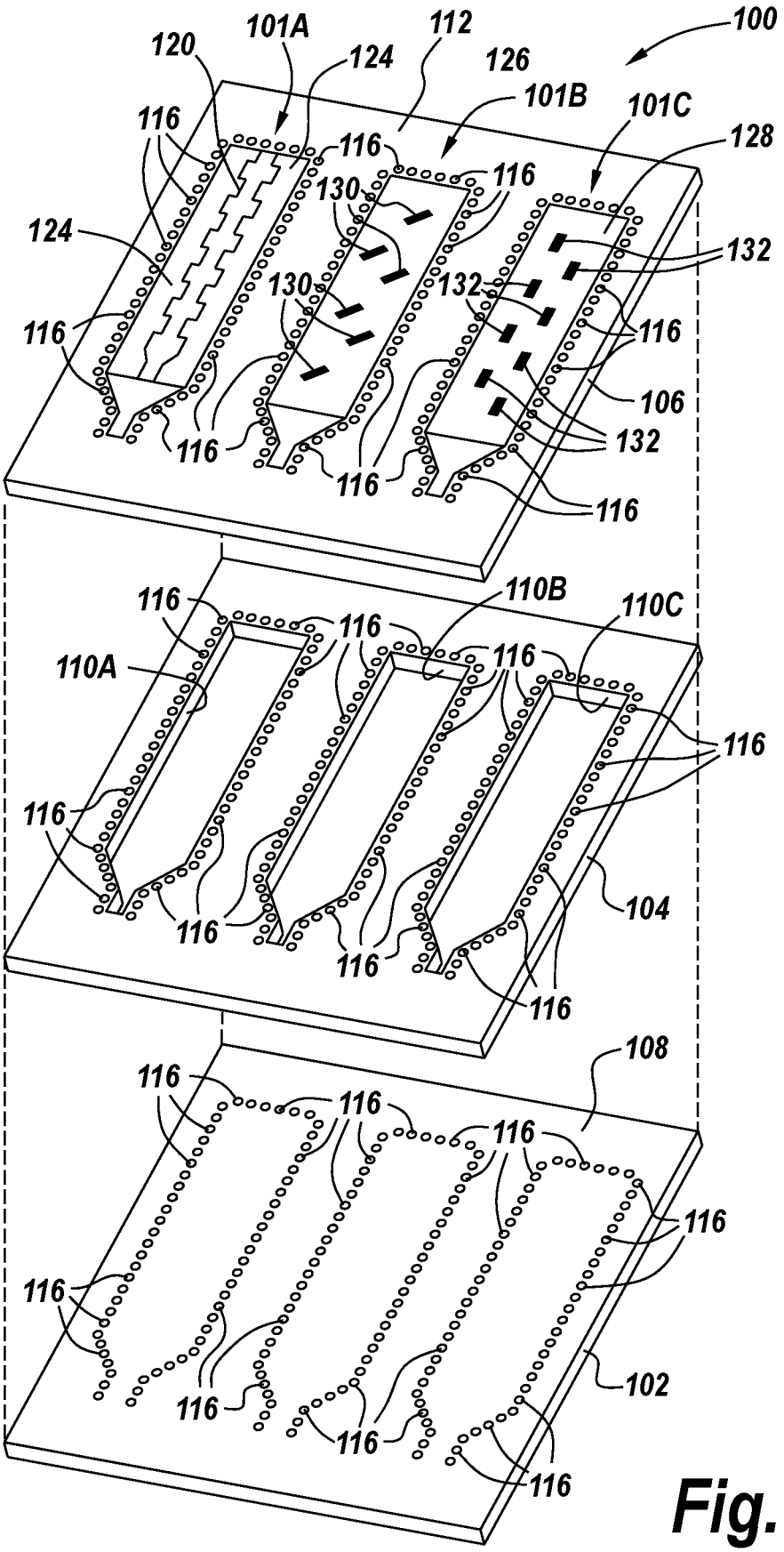
FIG. 1 includes a schematic perspective exploded view of a laminate antenna structure, according to some exemplary embodiments.

FIG. 1 includes a schematic perspective exploded view of a laminate antenna structure, according to some exemplary embodiments. FIG. 1 illustrates the structure of three different antenna structures 101A, 101B and 101C, produced according to the techniques of the present disclosure. Referring to FIG. 1, antenna 101A is a radiating differential patch antenna, and antennas 101B and 101C are different waveguide slot antennas configured to have different polarizations, such as vertical or horizontal polarizations. The antenna structures can also be implemented as differential pair antennas. Antenna structure 100 includes multiple, e.g., three, laminate layers 102, 104, 106 of low-cost PCB material such as FR4, stacked as shown. In some particular exemplary embodiments, each laminate layer 102, 104, 106 may have a nominal thickness of approximately 125 μm to 1.5 mm. It should be noted that thickness of any of layers 102, 104, 106 can be selected based on desired performance characteristics of one or more of antennas 101A, 101B, 101C, and/or any associated circuitry.

Lower laminate layer 102 can include a thin layer 108 of conductive material such as a metallic material such as copper (Cu), formed on its top surface to serve as a ground plane for structure 100 and waveguide antennas 101A, 101B, and/or 101C. In some particular exemplary embodiments, conductive layer 108 may have a nominal thickness of approximately 50 μm while the laminate layer 102 may have a thickness of about 1.5 mm.

Middle laminate layer 104 provides spacing between lower laminate layer 102 and upper laminate layer 106. It also provides the cavities for waveguide antennas 101A, 101B, and 101C. Waveguide cavities 110A, 110B, 110C are stamp cut in laminate layer 104 to be positioned between the RF top layer, i.e., upper laminate layer 106, and bottom ground layer, i.e., lower laminate layer 102.

Upper laminate layer 106 can include a thin conductive layer 112 of conductive material such as a metallic material such as copper (Cu), formed on its top surface. Conductive layer 112 can be etched by any known etching process to configure waveguide antennas 101A, 101B, 101C as desired. For example, waveguide antenna 101A can be a differential patch antenna. As such, antenna 101A includes a region 124 of conductor, e.g., metal such as Cu. Conductive region 124 is etched to selectively remove the conductive material to form a pattern 120 of nonconductive patches, free of the metallic conductive material. The result is a waveguide antenna with radiative differential patches, in which the sizes, orientations, quantity and other features of the patches are selected based on desired performance characteristics of the waveguide antenna.

Antennas 101B and 101C are different waveguide slot antennas. In exemplary embodiments, conductive regions 126, 128 are etched to selectively remove the conductive material to form patterns of nonconductive slots 130, 132, free of the metallic conductive material. The result is waveguide slot antennas 101B and 101C with radiative differential slots, in which the sizes, orientations, quantity and other features of the slots are selected based on desired performance characteristics of the waveguide antenna.

It will be noted that the configuration of antennas 101A, 101B and 101C illustrated in FIG. 1 is selected as an exemplary illustration. That is, the illustration of a single waveguide differential patch antenna and two waveguide differential slot antennas is exemplary only. According to the present disclosure, the quantity, type and combinations of types of antennas can be varied in different antenna structures, based on the desired performance of the overall system.

After lamination of the multiple layers 102, 104, 106, stamp-cut cavities 110A, 110B, 110C in laminate layer 104, lower laminate layer 102 and upper laminate layer 106 form the air-filled waveguides, which can be used as waveguide antennas 101A, 101B, and 101C. After lamination, according to the exemplary embodiments, isolating and grounding vias can be drilled around the waveguide cavities 110A, 110B, 110C through the structure as shown and metallized according to any known metallization process. Through vias 116 pass through all layers 102, 104, 106, eliminating the cost and complexity of blind or buried vias. Vias 116 define the extents of waveguide cavities 102, 104, 106.

According to the present disclosure, thickness of laminate layers can be selected according to the desired performance characteristics of the resulting antenna. One or more laminates of desired thickness can also be placed over the RF side of the antenna structure to serve as a radome covering the radiating slots for protection as well as contributing to the desired radiation properties of the antenna. The use of these multiple laminates greatly reduces the cost and complexity of the fabrication process.

According to the present disclosure, radar antennas for automotive applications are provided, the antenna structures using only standard low-cost non-RF laminates, such as FR4 substrates, to form waveguides, feed lines and radiating antenna elements, which are configured to radiate fundamental or higher-order modes, as desired. The radar antennas can be integrated with the rest of the RF circuitry and associated digital circuitry in a single board, fabricated using common, well-known circuit fabrication techniques and materials. The disclosure includes antenna feeding structures, waveguide-based antennas, differential radiating patches for different pattern characteristics and polarizations, as well as multiple RF power transmissions, combiners and coupling structures. Using near-lossless, high-efficiency air-filled waveguides for antennas and feeder lines, and also using single-material, low-cost standard laminate fabrication processes provide significant improvements over current approaches using multiple materials and traditional techniques for antennas such as patch antennas, since such antennas are prone to many issues since the material properties are subject to variations due to manufacturing or fabrication processes, which is in contrast to the approach of the present disclosure, in which air is used as the dielectric material. According to the present disclosure, the antenna system can include multiple waveguide cavities and radiating slots comprising multiple transmit and receive antennas tightly placed in a single laminar package.

Figure 2:
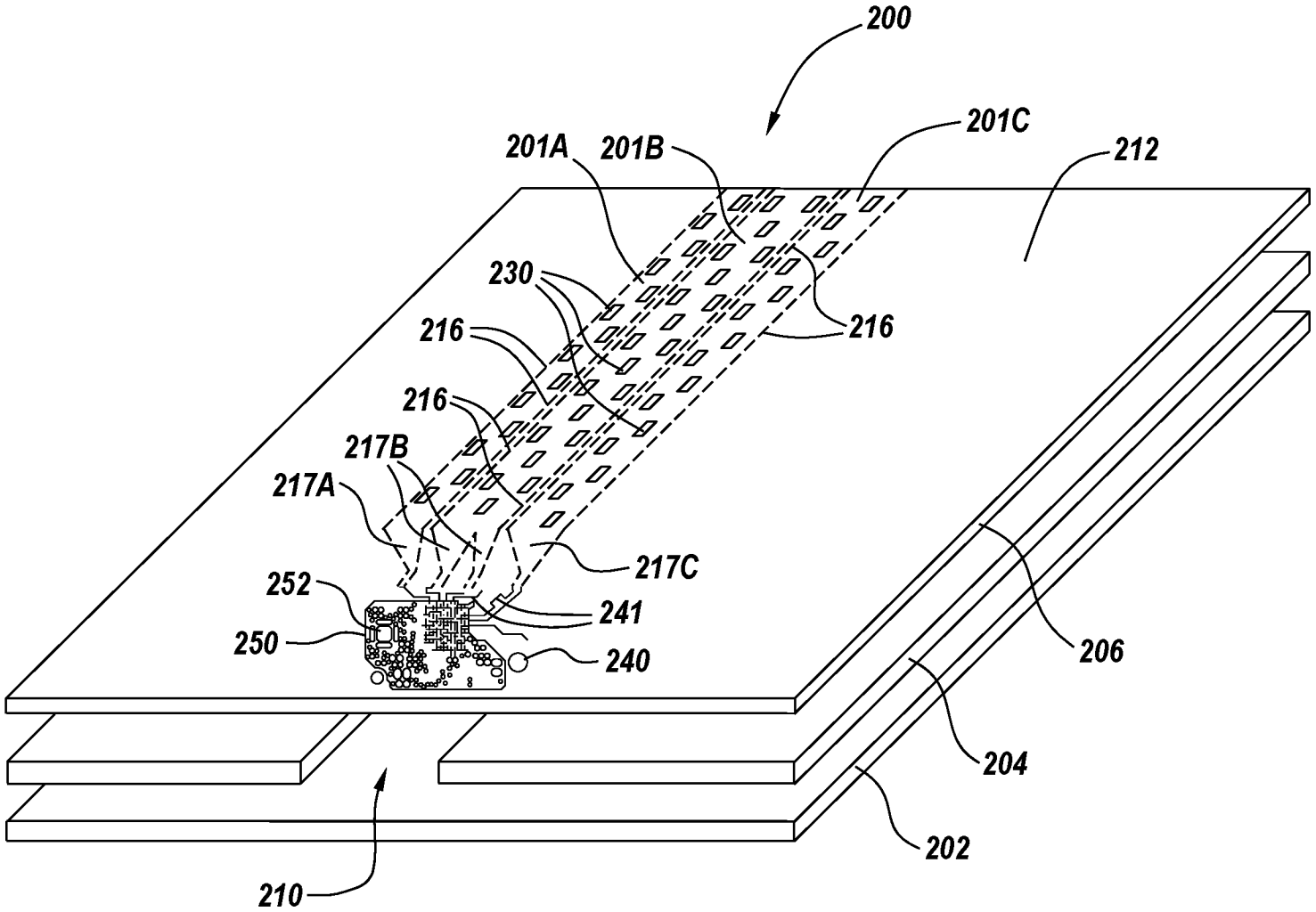
FIG. 2 includes a schematic perspective exploded view of an electronics structure, according to some exemplary embodiments.

FIG. 2 includes a schematic perspective exploded view of an electronics structure 200, according to some exemplary embodiments. Referring to FIG. 2, structure 200 includes three laminate layers 202, 204, 206 of low-cost, non-RF PCB material, such as FR4, with waveguide slot antennas 201A, 201B, 201C formed therein as described above in detail in connection with FIG. 1. Laminate layer 204 includes a stamped cut-out area 210, which creates the air-filled waveguide cavity for structure 200. In the illustrated embodiment, each of antennas 201A, 201B, 201C includes an array of slots 230 etched through top conductor layer 212 formed on the top surface of top laminate layer 206. As described above, conductor layer 212 can include a conductive material, such as a metallic material, such as copper (Cu), deposited on top laminate layer 206. As described above, the sizes, orientations, spacing, quantity, etc. of slots 230 are selected based on desired performance characteristics of structure 200. Each of antennas 201A, 201B, 201C also includes metallized via through holes 216 to create the waveguide isolation area between conductive layers of the waveguides on opposite sides of the waveguide cavities.

Each of antennas 201A, 201B, 201C also includes a transition region 217A, 217B, 217C for the feeding structure connecting the waveguide antennas 201A, 201B, 201C to additional circuitry 240, which in some exemplary embodiments is formed integrally in upper laminate layer 206 and/or other layers. Additional circuitry 240 can include microstrip lines 241 connecting transition regions 217A, 217B, 217C to other associated circuitry 250, which can include, for example, electronic components, such as digital components, such as processors, memories, integrated circuits, amplifiers, buses, as well as individual passive electronic components, e.g., resistors, capacitors, etc. Other RF front end associated circuitry of associated circuitry 250 may also include a monolithic microwave integrated circuit (MMIC) 252 and/or other circuitry associated with the RF front end of the system.

Figure 3A:
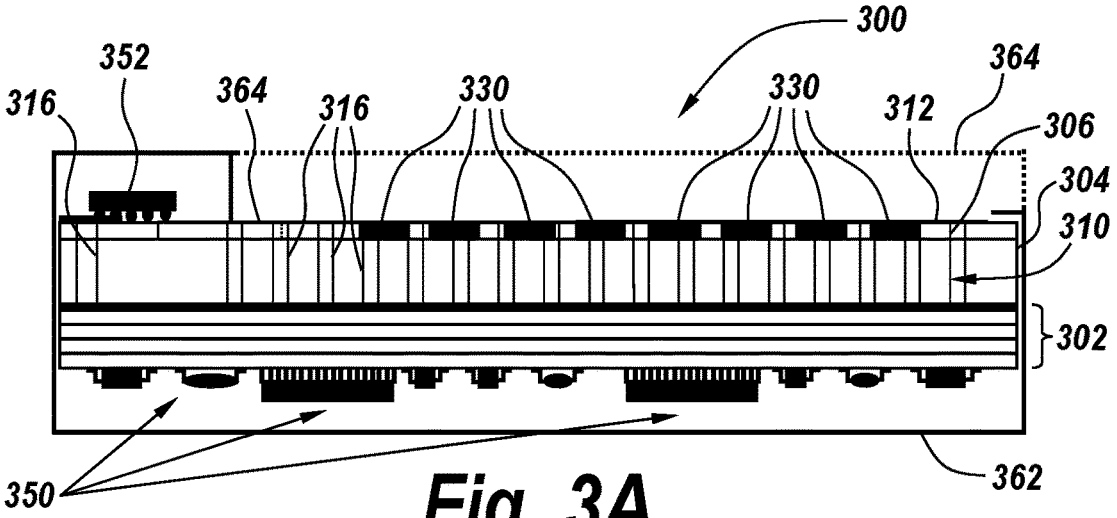
FIGS. 3A through 3C include schematic cross-sectional views of multiple alternative configurations of radar sensors, according to some exemplary embodiments. Specifically.
Figure 3B:
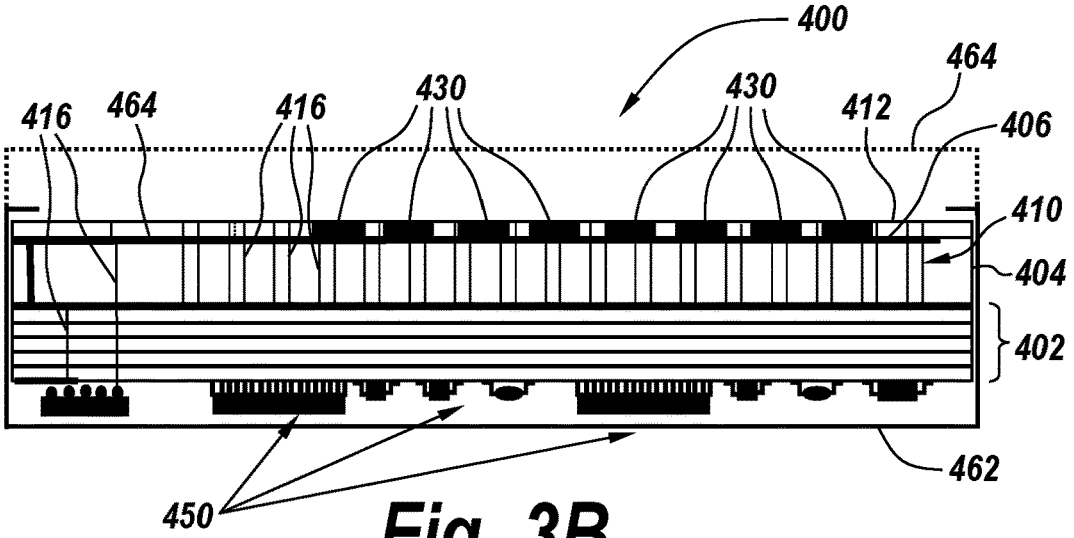
Figure 3C:
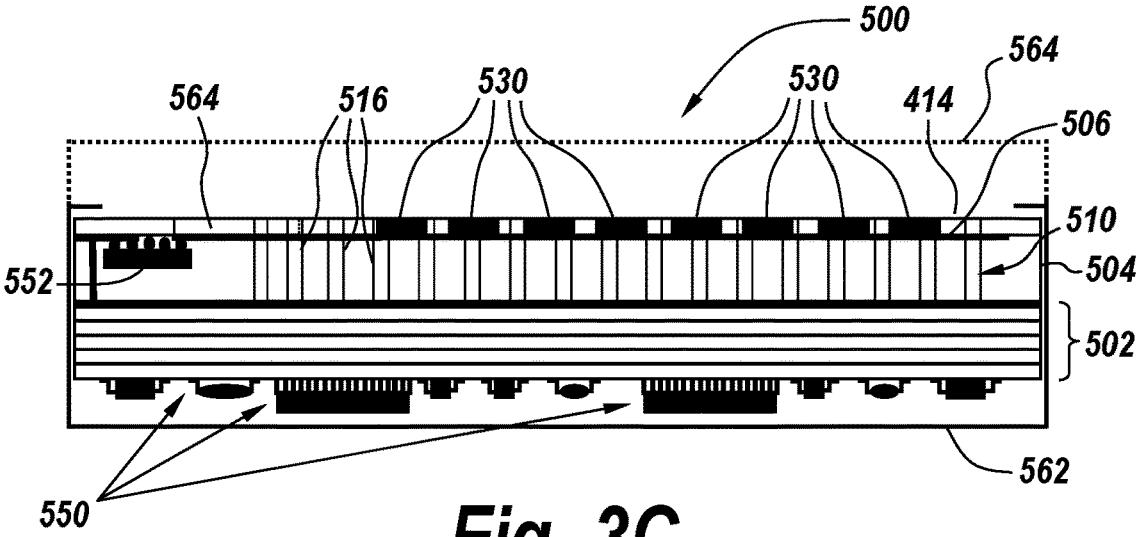

FIGS. 3A through 3C include schematic cross-sectional views of multiple alternative configurations of radar sensors, according to some exemplary embodiments. Specifically, FIG. 3A illustrates a configuration in which MIMIC 252 and/or other RF front end associated circuitry 250 of the system is located on the top laminate layer of the structure, FIG. 3B illustrates a configuration in which MIMIC 252 and/or other RF front end associated circuitry 250 of the system is located on the bottom side of the bottom laminate layer of the structure, and FIG. 3C illustrates a configuration in which MMIC 252 and/or other RF front end associated circuitry 250 of the system is located on the bottom side of the top laminate layer, such that MIMIC 252 is located within the waveguide cavity of the structure.

Referring to FIG. 3A, radar sensor 300 includes multiple lower or bottom laminate layers 302 of non-RF material, e.g. FR4, which are analogous to the single lower or bottom laminate layers 102 and 202 of the embodiments of FIGS. 1 and 2, respectively. Middle laminate layer 304 of non-RF material includes the waveguide cavity 310, which can be punch cut into laminate layer 304 to form the air-filled waveguide cavity of the present disclosure. Middle laminate layer 304 is analogous to middle laminate layers 104 and 204 of the embodiments of FIGS. 1 and 2, respectively. Upper or top laminate layer 306 is analogous to upper or top laminate layers 106 and 206 of the embodiments of FIGS. 1 and 2, respectively. Upper laminate layer 306 includes a conductive layer 312, which can be a metallic layer made of, for example, copper. Conductive layer 312 is etched to form radiative slots 330, analogous to slots 130, 132, 230 and patches 120 of FIGS. 1 and 2.

FIG. 3A also illustrates an outer sensor package 362, which encloses the electronics of sensor 300. Also, sensor 300 can optionally include a radome 364, which serves to protect the interior of sensor 300 from the environment and can be formed of low-cost non-RF material such as FR4.

In the embodiment depicted in FIG. 3A, associated circuitry 350, which can include, for example, electronic components, such as digital components, such as processors, memories, integrated circuits, amplifiers, buses, as well as individual passive electronic components, e.g., resistors, capacitors, etc., is mounted on the bottom side of lower laminate layers 302. Other circuitry, which can include RF front end circuitry and/or MMIC 352, can be mounted on the top surface of upper laminate layer 306. One or more grounding RF vias 316 used to enclose the waveguiding area connect MMIC 352 to lower grounding layers of the structure, and a feed line and transition 364 connects the waveguide to MIMIC 352 and/or other RF front end circuitry/devices. It should be noted that grounding vias 316 could penetrate any number of multiple lower or bottom laminate layers 302, including all of layers 302, such that the number of steps required to form grounding vias 316 can be reduced.

Referring to FIG. 3B, radar sensor 400 includes multiple lower or bottom laminate layers 402 of non-RF material, e.g. FR4, which are analogous to the single lower or bottom laminate layers 102 and 202 of the embodiments of FIGS. 1 and 2, respectively. Middle laminate layer 404 of non-RF material includes the waveguide cavity 410, which can be punch cut into laminate layer 404 to form the air-filled waveguide cavity of the present disclosure. Middle laminate layer 404 is analogous to middle laminate layers 104 and 204 of the embodiments of FIGS. 1 and 2, respectively. Upper or top laminate layer 406 is analogous to upper or top laminate layers 106 and 206 of the embodiments of FIGS. 1 and 2, respectively. Upper laminate layer 406 includes a conductive layer 412, which can be a metallic layer made of, for example, copper. Conductive layer 412 is etched to form radiative slots 430, analogous to slots 130, 132, 230 and patches 120 of FIGS. 1 and 2.

FIG. 3B also illustrates an outer sensor package 462, which encloses the electronics of sensor 400. Also, sensor 400 can optionally include a radome 464, which serves to protect the interior of sensor 400 from the environment and can be formed of low-cost non-RF material such as FR4.

In the embodiment depicted in FIG. 3B, associated circuitry 450, which can include, for example, electronic components, such as digital components, such as processors, memories, integrated circuits, amplifiers, buses, as well as individual passive electronic components, e.g., resistors, capacitors, etc., is mounted on the bottom side of lower laminate layers 402. Other circuitry, which can include RF front end circuitry and/or MMIC 452, can also be mounted on the bottom side of lower laminate layers 402. One or more grounding RF vias 416 used to enclose the waveguiding area connect MIMIC 452 to lower grounding layers of the structure, and a feed line and transition 464 connects the waveguide to MMIC 452 and/or other RF front end circuitry/devices. It should be noted that grounding vias 416 could penetrate any number of multiple lower or bottom laminate layers 402, including all of layers 402, such that the number of steps required to form grounding vias 416 can be reduced.

Referring to FIG. 3C, radar sensor 500 includes multiple lower or bottom laminate layers 502 of non-RF material, e.g. FR4, which are analogous to the single lower or bottom laminate layers 102 and 202 of the embodiments of FIGS. 1 and 2, respectively. Middle laminate layer 504 of non-RF material includes the waveguide cavity 510, which can be punch cut into laminate layer 504 to form the air-filled waveguide cavity of the present disclosure. Middle laminate layer 504 is analogous to middle laminate layers 104 and 204 of the embodiments of FIGS. 1 and 2, respectively. Upper or top laminate layer 506 is analogous to upper or top laminate layers 106 and 206 of the embodiments of FIGS. 1 and 2, respectively. Upper laminate layer 506 includes a conductive layer 512, which can be a metallic layer made of, for example, copper. Conductive layer 512 is etched to form radiative slots 530, analogous to slots 130, 132, 230 and patches 120 of FIGS. 1 and 2.

FIG. 3C also illustrates an outer sensor package 562, which encloses the electronics of sensor 500. Also, sensor 500 can optionally include a radome 564, which serves to protect the interior of sensor 500 from the environment and can be formed of low-cost non-RF material such as FR4.

In the embodiment depicted in FIG. 3C, associated circuitry 550, which can include, for example, electronic components, such as digital components, such as processors, memories, integrated circuits, amplifiers, buses, as well as individual passive electronic components, e.g., resistors, capacitors, etc., is mounted on the bottom side of lower laminate layers 502. Other circuitry, which can include RF front end circuitry and/or MMIC 552, can be mounted on the bottom side of upper laminate layer 506, such that MIMIC 552 is located within waveguide cavity 510. One or more grounding RF vias 516 used to enclose the waveguiding area connect MMIC 552 to lower grounding layers of the structure, and a feed line and transition 564 connects the waveguide to MIMIC 552 and/or other RF front end circuitry/devices. It should be noted that grounding vias 516 could penetrate any number of multiple lower or bottom laminate layers 502, including all of layers 502, such that the number of steps required to form grounding vias 516 can be reduced.

Figure 4:
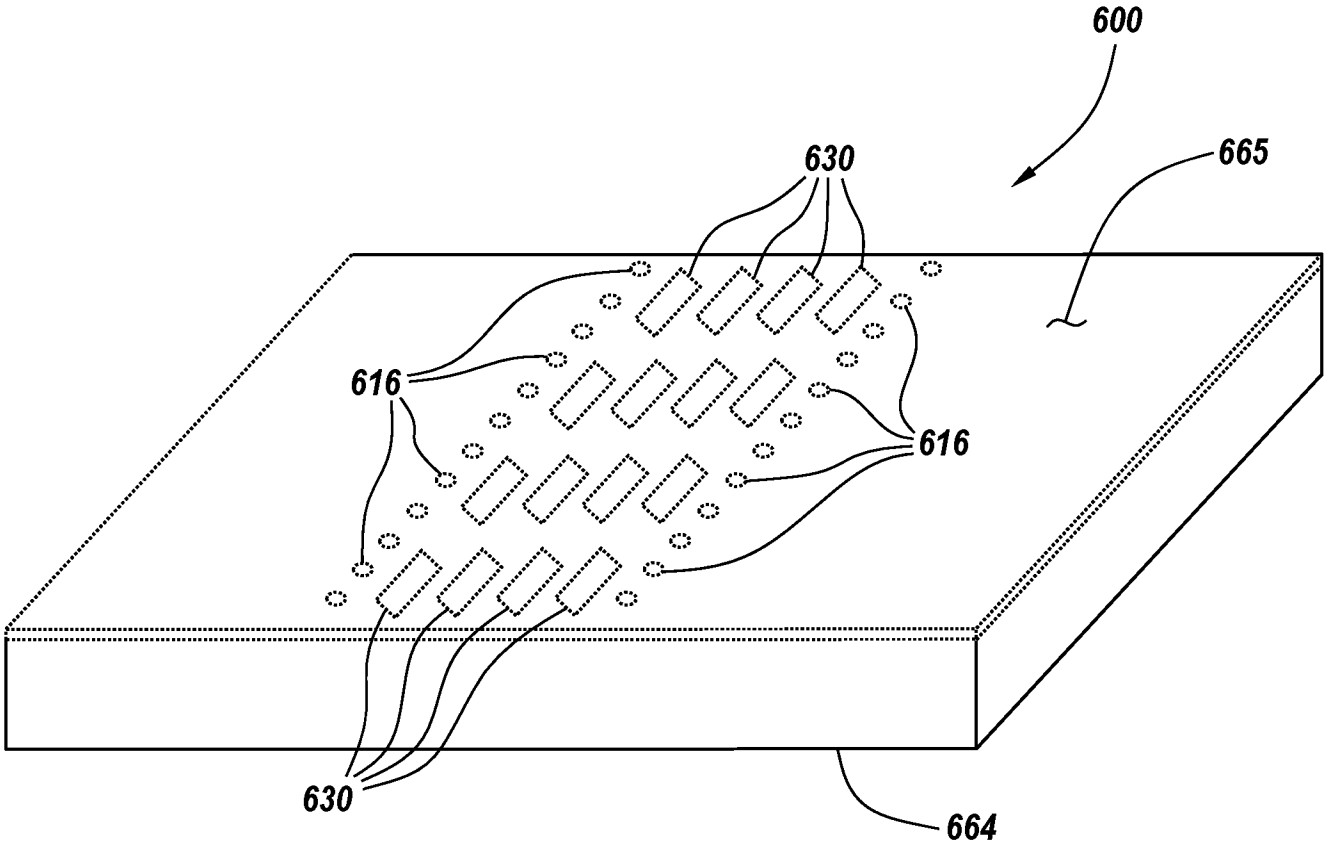
FIG. 4 includes a schematic perspective view of a packaged radar sensor having at least one waveguide antenna structure, according to some exemplary embodiments.

FIG. 4 includes a schematic perspective view of a packaged radar sensor 600 having at least one waveguide antenna structure, according to some exemplary embodiments. Referring to FIG. 4, radar sensor 600 includes a sensor package 664 with a top cover or radome 665 attached to package 664. The antenna structure includes through vias 616 passing through the structure and defining the extents of the waveguide antenna. Also shown are the radiating slots 630 for radiating RF energy from the waveguide contained within radar sensor 600.

According to the present disclosure, a unique embedded waveguide between two top and bottom conductive layers confined by row of conductive vias in a laminate structure)

carries a high-frequency signal. Properly configured, spaced, size and oriented radiating slots allow the structure to function as an antenna. The radiating slots on the top layer can take different shapes and orientations depending on the required radiation properties of the antenna in the sensor. A variety of antenna configurations are achieved including different radiation pattern features, i.e., gain, beam width, polarization, etc.

Several advantages are realized by the structure and techniques of the present disclosure. For example, No RF material is required in the automotive radar sensor or any other high-frequency circuitry to transmit and radiate high frequency signal. This results in a lower-cost radar sensor. Also, the medium used to transmit the electromagnetic wave is all air, i.e., not traditional planar dielectric laminates. This provides low loss and low dispersion superior to all other substrate materials which are far more lossy and more prone to dispersive behavior while interacting with high frequency waves. Also, relatively non-complex manufacturing and laminating processes and materials (such as commonly used FR4) can be used with no special arrangement or processes required. Furthermore, since the digital circuitry (non-RF circuitry) commonly uses the same low-cost substrate (such as FR4), compact integrated solutions are achieved in a standard low-cost manufacturing process. By eliminating the need for expensive and difficult-to-fabricate RF laminates, overall cost of the sensor can be reduced significantly while maintaining or improving sensor performance.

Whereas many alterations and modifications of the disclosure will become apparent to a person of ordinary skill in the art after having read the foregoing description, it is to be understood that the particular embodiments shown and described by way of illustration are in no way intended to be considered limiting. Further, the subject matter has been described with reference to particular embodiments, but variations within the spirit and scope of the disclosure will occur to those skilled in the art. It is noted that the foregoing examples have been provided merely for the purpose of explanation and are in no way to be construed as limiting of the present disclosure.

While the present inventive concept has been particularly shown and described with reference to exemplary embodiments thereof, it will be understood by those of ordinary skill in the art that various changes in form and details may be made therein without departing from the spirit and scope of the present inventive concept as defined by the following claims.

The invention claimed is:

1. An apparatus, comprising:

a lower laminate layer of non-radio-frequency (RF) material, the non-RF material being glass-reinforced epoxy laminate material;

a middle layer of the non-RF material formed over the first layer of conductive material, the middle layer of the non-RF material comprising a waveguide cavity formed through the middle layer of the non-RF material, such that air forms a propagation medium for radiation in the waveguide cavity, a thickness of the middle layer of the non-RF material defining a dimension of the waveguide cavity;

an upper layer of the non-RF material formed over the middle layer of the non-RF material;

a first layer of conductive material formed under the middle layer of the non-RF material; and a second layer of conductive material formed over the middle layer of the non-RF material, the first and second layers of conductive material and the waveguide cavity being part of a waveguide antenna.

2. The apparatus of claim 1, wherein the second layer of conductive material comprises a pattern of openings.

3. The apparatus of claim 2, wherein the pattern of openings comprises a pattern of slots such that the waveguide antenna is a slot antenna.

4. The apparatus of claim 2, wherein the pattern of openings comprises a pattern of patch openings such that the waveguide antenna is a slotted waveguide antenna.

5. The apparatus of claim 2, wherein the pattern of openings comprises a pattern of patch openings such that the waveguide antenna can be configured as a differential pair antenna.

6. The apparatus of claim 2, further comprising a protecting layer of the non-RF material formed over the second layer of conductive material to seal the openings, the protecting layer functioning as a radome.

7. The apparatus of claim 1, further comprising a plurality of through vias formed through the layers of the non-RF material and surrounding the waveguide cavity to define a boundary of the waveguide cavity.

8. The apparatus of claim 1, further comprising a feeding structure for coupling the waveguide antenna to associated circuitry.

9. The apparatus of claim 8, wherein the associated circuitry is formed on at least one of the lower and upper layers of the non-RF material.

10. The apparatus of claim 8, wherein the associated circuitry is formed on both of the lower and upper layers of the non-RF material.

11. The apparatus of claim 8, wherein the associated circuitry comprises a monolithic microwave integrated circuit (MMIC).

12. The apparatus of claim 8, wherein:

the associated circuitry comprises a monolithic microwave integrated circuit (MMIC) mounted over the top surface of the upper layer of the non-RF material and other associated circuitry mounted under a bottom surface of the lower layer of the non-RF material; and the feeding structure comprises a first connection between the MIMIC and the other associated circuitry and a second connection between the MIMIC and the waveguide antenna.

13. The apparatus of claim 8, wherein:

the associated circuitry comprises a monolithic microwave integrated circuit (MMIC) and other associated circuitry mounted under a bottom surface of the lower layer of the non-RF material; and the feeding structure comprises a connection between the MIMIC and the waveguide antenna.

14. The apparatus of claim 8, wherein:

the associated circuitry comprises a monolithic microwave integrated circuit (MMIC) mounted under a bottom surface of the upper layer of the non-RF material and within the waveguide cavity and other associated circuitry mounted under a bottom surface of the lower layer of the non-RF material; and the feeding structure comprises a connection between the MIMIC and the waveguide antenna.

15. The apparatus of claim 1, wherein the waveguide antenna is a receive antenna structure.

16. The apparatus of claim 1, wherein the waveguide antenna is a transmit antenna structure.

17. The apparatus of claim 1, further comprising multiple waveguide cavities and radiating slots forming multiple transmit and receive antennas tightly placed in a single laminar package.

18. The apparatus of claim 1, wherein a configuration of radiating slots is selected to radiate various polarizations such as vertical and/or horizontal polarizations.

19. The apparatus of claim 1, wherein:

the first layer of conductive material is formed on a top surface of the lower laminate layer of the non-RF material; and the second layer of conductive material is formed on a top surface of the upper layer of the non-RF material.

* * * * *